US005443437A

United States Patent [19]

Mack

[11] Patent Number: 5,443,437

[45] Date of Patent: Aug. 22, 1995

[54] DEVICE FOR AUTOMATICALLY ADJUSTING A FOLD IN A FOLDING APPARATUS OF A ROTARY PRINTING MACHINE

[75] Inventor: Richard Mack, Heidelberg, Germany

[73] Assignee: Heidelberger Druckmaschinen, Heidelberg, Germany

[21] Appl. No.: 227,200

[22] Filed: Apr. 13, 1994

Related U.S. Application Data

[63] Continuation of Ser. No. 973,310, Nov. 9, 1992, abandoned.

[30] Foreign Application Priority Data

Nov. 8, 1991 [DE] Germany ..... 41 36 792.8

[51] Int. Cl.[6] ..... B65H 45/16

[52] U.S. Cl. ..... 493/359; 493/429; 493/476

[58] Field of Search ..... 493/23, 320, 321, 324, 493/359, 360, 427, 428, 429, 476

[56] References Cited

U.S. PATENT DOCUMENTS

| | | | |
|---|---|---|---|
| 3,540,723 | 11/1970 | Bolza-Schuenemann et al. | 493/360 |
| 3,608,889 | 9/1971 | Woessner et al. | 493/360 |
| 3,784,187 | 1/1974 | Takayanagi et al. | 493/359 |
| 4,090,701 | 5/1978 | Von Hein | 493/427 |
| 4,176,833 | 12/1979 | Heimlicher | 493/359 |
| 4,822,329 | 4/1989 | Schneider | 493/359 |
| 4,936,561 | 6/1990 | Mukai | 493/476 |
| 4,969,862 | 11/1990 | Ehlscheid | 493/359 |
| 5,057,064 | 10/1991 | Michalik | 493/8 |
| 5,122,109 | 6/1992 | Kubota et al. | 493/427 |

FOREIGN PATENT DOCUMENTS

| | | |
|---|---|---|
| 0352625 | 1/1990 | European Pat. Off. . |
| 0385818 | 9/1990 | European Pat. Off. . |
| 1279033 | 5/1969 | Germany . |
| 1786292 | 1/1972 | Germany . |

*Primary Examiner*—Jack W. Lavinder
*Attorney, Agent, or Firm*—Herbert L. Lerner; Laurence A. Greenberg

[57] ABSTRACT

A folding apparatus of a rotary printing machine includes a combination of a plurality of folded-product guiding cylinders including at least one cylinder with adjustable folding blades and impaling pins, and at least one cylinder with folding jaws, and transfer cylinders with gripper devices as well as perforating devices, the folding blades, the impaling pins, the folding jaws, the gripper devices and the perforating devices being adjustably mounted in the respective cylinders adjacent respective outer cylindrical surfaces thereof, a device operatively connected to at least one of the cylinders for automatically adjusting a fold, the adjusting device being actuatable for varying respective operating positions of the folding blades, the impaling pins, the folding jaws, the gripper elements and the perforating elements relative to one another at the respective outer cylindrical surfaces of the respective cylinders, and a remotely controllable drive for operating the adjusting device.

9 Claims, 5 Drawing Sheets

31

12
22
20a
17.1
35
30
23
27
34
26
34
24
29
33
19.1
28
20b

DEVICE FOR AUTOMATICALLY ADJUSTING A FOLD IN A FOLDING APPARATUS OF A ROTARY PRINTING MACHINE

This application is a continuation of application Ser. No. 07/973,310, filed Nov. 9, 1992, abandoned.

BACKGROUND OF THE INVENTION

FIELD OF THE INVENTION

The invention relates to a device for automatically adjusting a fold in a folding apparatus of a rotary printing machine.

A variable folding unit for web-fed rotary printing machines has become known in the prior art from German Patent 12 79 033, wherein a folding cylinder formed of a gripper part and a folding-blade part has two planetary-gear drives as well as two clutches. The folding-blade part is adjustable in circumferential direction by one of the planetary-gear drives, while a control cam for the gripper part is adjustable by the other planetary-gear drive. The adjustment of the folding-blade part and of the gripper-control cam is performed in common, i.e., both together, with respect to the gripper part of the folding cylinder, when the clutches are disengaged. During normal operation, the planetary-gear drives idle.

German Published Non-Prosecuted Application (DE-OS) 17 86 292 discloses a device for adjusting impaling pins on folding-blade collecting cylinders in folders of rotary printing machines. In this heretofore known device, impaling pins provided on a folding-blade collecting cylinder are controlled by follower rollers running on a control cam of a cam member. The cam is adjusted and, accordingly, the pins are operated by means of a helical ring gear and a helical gear, which are in meshing engagement with adjusting gearwheels mounted on an axially displaceable adjusting bolt. A disadvantage of this known device is the high outlay required for equipment to operate only one row of impaling pins on the folding-blade collecting cylinder.

European Published Non-Prosecuted Application (EP-OS) 0 385 818 discloses a device for cutting and folding a printed paper web. A folding cylinder carries at least one movable folding blade, which can be moved between two positions. It can either remain below the outer cylindrical surface of the folding cylinder or it can be used to form a second transverse fold, if such a fold should be desired. Through the intermediary of a V-shaped roller lever, it is possible to alternate between the retracted at-rest position and the extended working position.

The aforedescribed constructions of the prior art entail a considerable outlay for equipment to realize changeover operations of folding blades and impaling pins. The changeovers are performed manually to a very great extent, and are difficult to automate due to the complexity and the required fine adjustment.

SUMMARY OF THE INVENTION

Proceeding from the state of the prior art, it is an object of the invention to provide a device for automatically adjusting a fold in a folding apparatus of a rotary printing machine which is space-saving and has few components, and to which is capable of being automated.

With the foregoing and other objects in view, there is provided, in accordance with the invention, in a folding apparatus of a rotary printing machine, the combination comprising a plurality of folded-product guiding cylinders including at least one cylinder with adjustable folding blades and impaling pins, and at least one cylinder with folding jaws, and transfer cylinders with gripper devices as well as perforating devices, the folding blades, the impaling pins, the folding jaws, the gripper devices and the perforating devices being adjustably mounted in the respective cylinders adjacent respective outer cylindrical surfaces thereof, a device operatively connected to at least one of the cylinders for automatically adjusting a fold, the adjusting device being actuatable for varying respective operating positions of the folding blades, the impaling pins, the folding jaws, the gripper elements and the perforating elements relative to one another at the respective outer cylindrical surfaces of the respective cylinders, and remotely controllable drive means for operating the adjusting means.

In accordance with another feature of the invention, the device for automatically adjusting a fold is disposed within one of the folded-product guiding cylinders.

Advantages which result from such a construction are that the integration of the actuating device into the folded-product guiding cylinder economizes on installation space in the region of the side walls, while use is made of the hollow space in the folded-product guiding cylinders. In the side walls, additional gearwheels which are used only during adjustment may also be dispensed with. This reduces the amount of moving mass, and there is no need for a double side wall for accommodating the additional gearwheels. It is possible to perform extremely accurate fine adjustment during production, so that correct fold formation can be maintained after the start-up phase. The remotely controllable drives permit super-fine adjustments of transverse and second longitudinal folds, even at high production speeds. Furthermore, both overfold or gripper fold adjustments, as well as total-fold adjustments, are possible. Time-consuming engagement and disengagement of gearwheels when the fold is being changed is no longer necessary. Because there are no preset latching positions, any desired or required relative adjustments are capable of being realized.

In accordance with a further feature of the invention, a respective one of the folded-product guiding cylinders has a drive shaft formed with a central bore, and power-supply means are connected via the drive shaft to the remotely controllable drive means for energizing the drive means. Consequently, the remotely controllable drive can be connected by the shortest possible route to a power-supply network.

In accordance with an additional feature of the invention, the remotely controllable drive means comprise an electric motor. Such an electric motor takes up a minimum of installation space in the folded-product guiding cylinder and can be simply flanged onto the end walls of the cylinder and connected to the remote-control system of the printing machine.

In accordance with an added feature of the invention, the adjusting device includes a worm-gear drive mounted in a respective one of the folding-product guiding cylinders, and means for connecting the remotely controllable drive means through the intermediary of the worm-gear drive to the folding blades, the impaling pins, the folding jaws, the gripper devices and the perforating devices.

It is possible thereby to ensure that the high accuracy of the folding adjustment, once set, is maintained and that, even at extremely high production speeds, no undesired changes in the folding adjustment occur.

In accordance with yet another aspect of the invention, there are provided, in a folding apparatus, a device for automatically adjusting a fold, and devices energized by a pressure-transmitting medium, including means for actuating the fold adjusting device via the energized devices for varying the operating positions of the folding blades, the impaling pins, the folding jaws, the gripper elements and the perforating elements relative to one another.

In accordance with yet a further feature of the invention, means are provided for regulating a second longitudinal fold through the intermediary of the adjusting device.

In accordance with yet an added feature of the invention, means are provided for centrally adjusting the folding jaws from a control console of the printing machine. This permits a job-specific presetting of the folding machine in the case of repeat jobs and saves a considerable amount of setting-up time.

In accordance with a further aspect of the invention, a perforating device is provided which comprises a pair of perforating rollers for forming perforations in a traveling web, an adjusting device operatively connected to at least one of the perforating rollers for varying positions of the perforations in the web, and remotely controllable drive means for operating the adjusting means.

Thus, if the adjustment device according to the invention is employed, it is possible for further adjustment and correction operations to be performed both during the setting-up of a job and also during production and for them to be incorporated into the remote-control system.

In accordance with a concomitant feature of the invention, a respective one of the folded-product guiding cylinders has a drive shaft, and a gear is mounted on the drive shaft outside the respective one guiding cylinder so as to be rotatable relative to the drive shaft, the device for automatically adjusting a fold being affixed to the gear.

Other features which are considered as characteristic for the invention are set forth in the appended claims.

Although the invention is illustrated and described herein as embodied in a device for automatically adjusting a fold in a folding apparatus of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
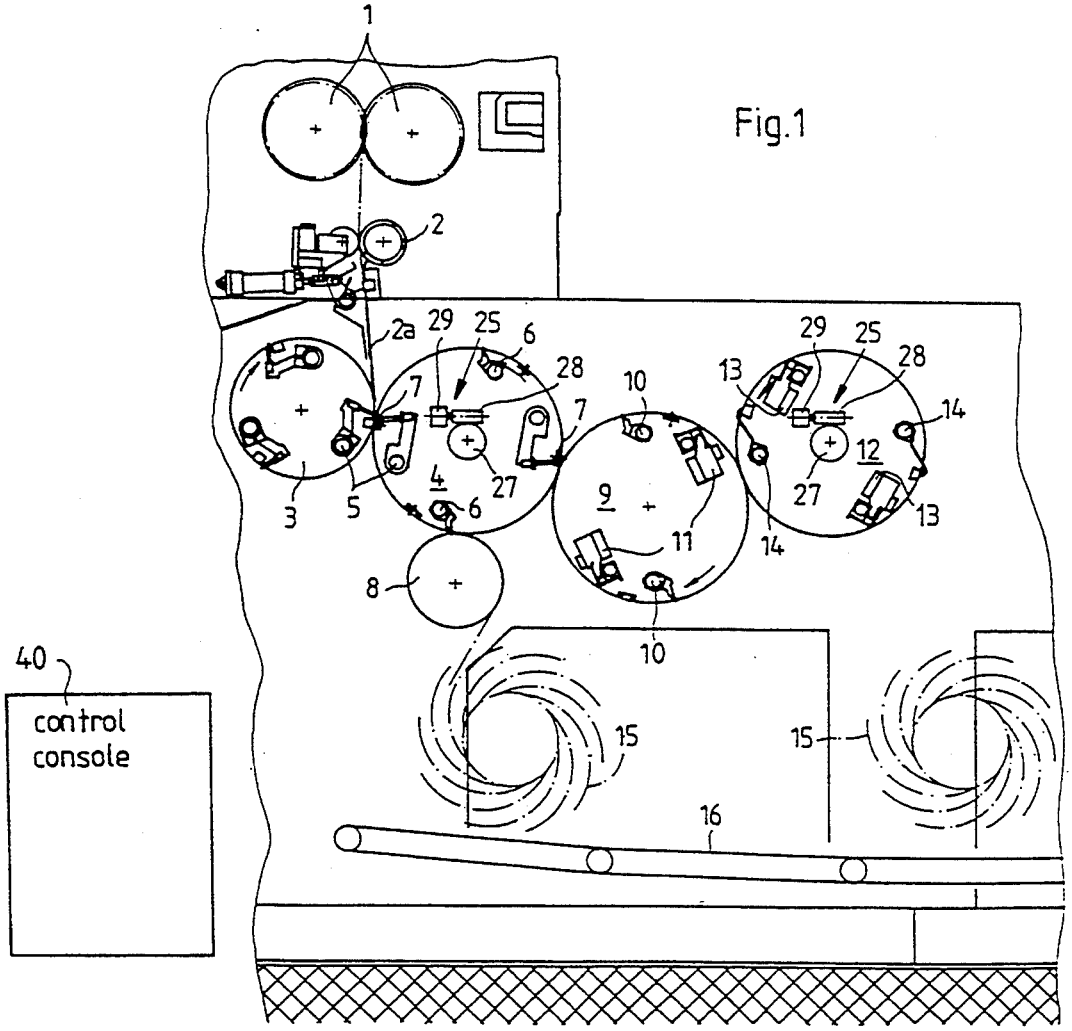
FIG. 1 is a fragmentary, diagrammatic side elevational view of a folding apparatus including the cylinder section thereof and incorporating the automatic fold-adjusting device according to the invention.

Referring now to the drawings and, first, particularly to FIG. 1, thereof, there is shown therein a paper web *2a,* which has traveled past perforating devices which comprise a pair of perforating rollers 1, is drawn into a folding apparatus by feed rollers 2 and is separated into individual folded products in a cylinder nip between a collecting cylinder 3 and a folded-product guiding cylinder 4. Situated below the folded-product guiding cylinder 4 is an impaling-pin cylinder 8 having an outer cylindrical surface engaging with an outer cylindrical surface of the folded-product guiding cylinder 4. The folded-product guiding cylinder 4 is provided with, respectively, two impaling pins 5, folding blades 6 and cutting blades 7, all of which cooperate with the collecting cylinder 3. The collecting cylinder 3 is likewise provided with impaling pins 5, with which folded products may be collected, depending upon the mode of production.

Behind or downstream of the folded-product guiding cylinder 4, in the direction of travel of the web *2a,* is another folded-product guiding cylinder 9, which has folding blades 10 and folding jaws 11 disposed on the outer cylindrical surface thereof. The folding blades 6 of the folded-product guiding cylinder 4 and the folding jaws 11 of the folded-product guiding cylinder 9 are employed for forming the first transverse fold in the folded product. By means of a folded-product guiding cylinder 12 located downstream from or behind the folded-product guiding cylinder 9, and folding jaws 13 carried by the cylinder 12, the second transverse fold may be formed. The changeover from the first and second transverse folds to the delta fold is shown in greater detail in FIGS. 4 and 5.

In the embodiment of the invention shown in FIG. 1, the folded-product guiding cylinders 4 and 12 are provided with adjusting devices 25. The adjusting devices 25 are formed of an electric motor 29, which is mounted in the region of an end face of the respective folded-product guiding cylinder 4,12, and moves a worm 28. The worm 28, in turn, meshes with a worm wheel 27 and, in this manner, moves the impaling pins 5 and the folding blades 6 of the folded-product guiding cylinder 4 relative to one another. Disposed below the folded-product guiding cylinders 4 and 12 are fans or paddle wheels 15, into which the folded products run before finally reaching a delivery 16.

Figure 2:
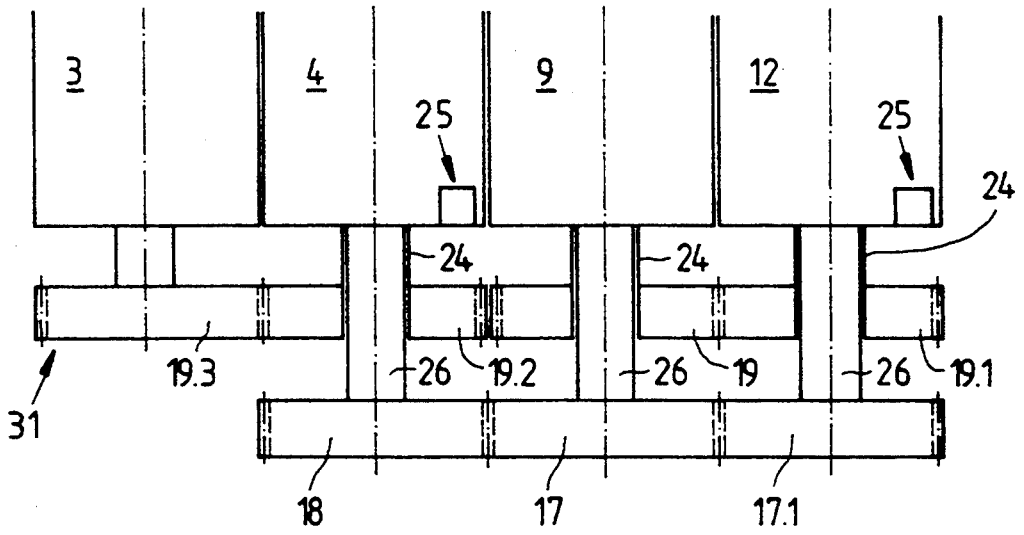
FIG. 2 is a fragmentary, diagrammatic top plan view of the cylinder section and a gear train therefor.

FIG. 2 provides a gear-train diagram of the cylinder section of the folding apparatus illustrated in FIG. 1. The collecting cylinder 3 and the folded-product guiding cylinders 4, 9 and 12 correspond to those in FIG. 1. Power is applied by a drive at 31. The power is transmitted via a gearwheel 19.3, a gearwheel 19.2 and a hollow shaft 24 rigidly connected thereto to the folded-product guiding cylinder 4; and via the adjusting device 25 in the folded-product guiding cylinder 4 to a shaft 26 with a central bore, and from the shaft 26 of the guiding cylinder 4, the power is transmitted to a gearwheel 18. The gearwheel 18, which meshes with a further gearwheel 17, applies a torque via a gearwheel 17.1 to a shaft 26 with a central bore of a folded-product guiding cylinder 12. The torque is applied via the adjusting device 25 of the folded-product guiding cylinder 12 to a hollow shaft 24 of the latter cylinder 12 and is transmitted to a gearwheel 19 via a gearwheel 19.1, which is connected to the hollow shaft 24 of the cylinder 12.

The gearwheel 19 is disposed on a hollow shaft 24 of the folded-product guiding cylinder 9. Through the intermediary of the actuating device 25 disposed in the folded-product guiding cylinder 12, a relative adjustment of the cylinder segments in the folded-product guiding cylinder 9 may also be effected, because the gearwheels 19.2 and 19 do not inter-mesh. In the embodiment illustrated in FIG. 2, the folded-product guiding cylinders 4 and 12 are furnished with adjusting devices 25, which move a gripper system 20*a* and a folding blade 20*b* (note FIG. 3) relative to one another on the folded-product guiding cylinder 12. The gearwheel 17.1 is firmly connected through the intermediary of the shaft 26, which is formed with a central bore, to the cylinder segment which carries the gripper system 20*a*, while the gearwheel 19.1 is connected, through the intermediary of the hollow shaft 24 of the cylinder 12, to the cylinder segment which has the folding blade 20*b*.

Figure 3:
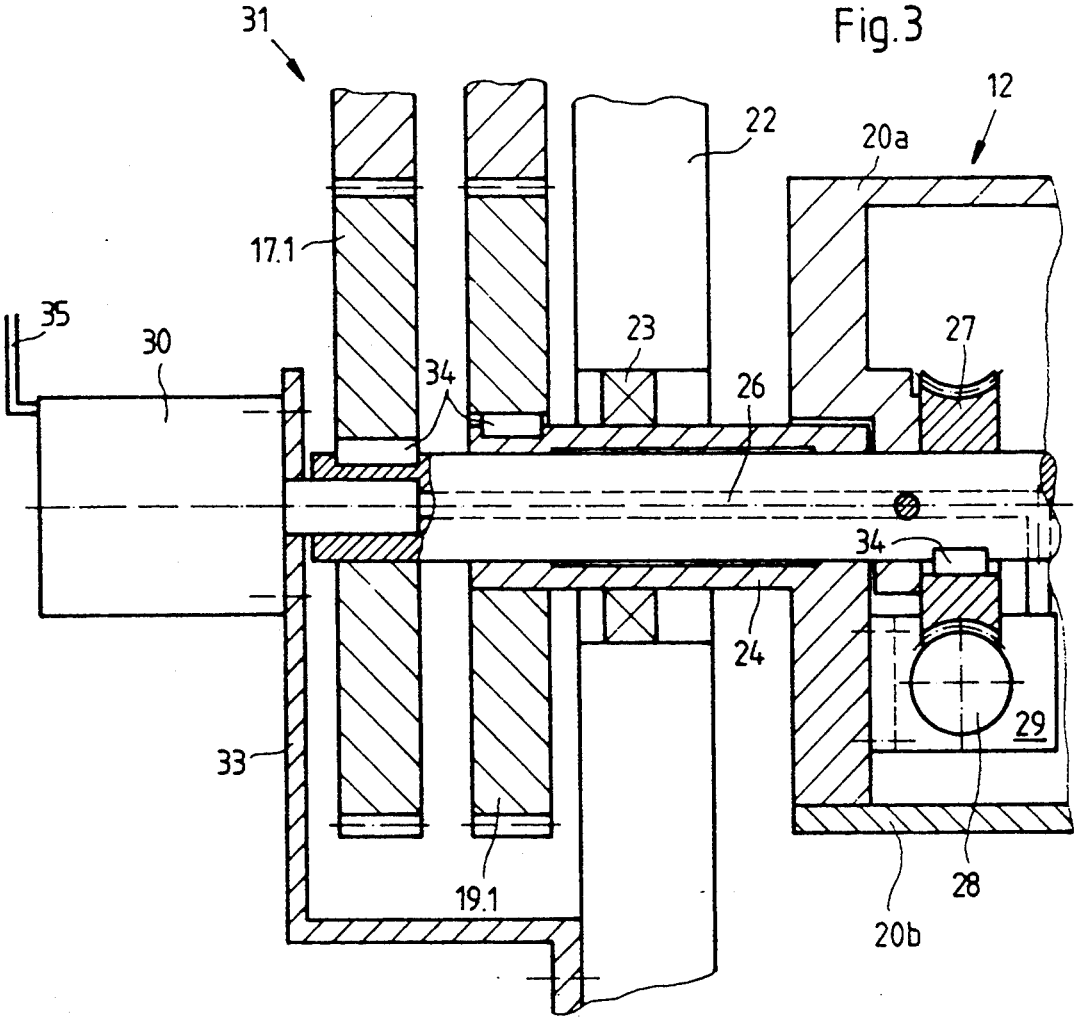
FIG. 3 is a partly diagrammatic, cross-sectional view of the adjusting device according to the invention together with a remotely controllable drive.

As is apparent from FIG. 3, the adjusting device 25 is located, in this case, for example, in the interior of the folded-product guiding cylinder 12. A remotely controllable drive, in this case, an electric motor 29, which is flanged onto an end wall of the folded-product guiding cylinder 12, drives a worm wheel 27 through the intermediary of a worm 28, the worm wheel 27 being mounted, through the intermediary of a feather key 34, on the shaft 26 formed with a central bore, so as to be fixed against relative rotation with the shaft 26. Through the central bore of the shaft 26, the electric motor 29 is connected via a line to a power supply section 30 outside the folded-product guiding cylinder 12. In the embodiment illustrated in FIG. 3, the power supply section 30 has an electrical connection 35 and is bolted to a side wall 22 of the folding apparatus through the intermediary of a bracket 33. The rotational energy transfer from the power supply section 30 to the electric motor 29 permits the drive to be installed inside the folded-product guiding cylinder 12.

Instead of an electric motor 29, electromagnets having adjustment travel paths which can be limited by stops may also be used, as well as pneumatic devices, which additionally have the advantage of very short switching times.

The electric motor 29 is flanged onto that part of the end face of the folded-product guiding cylinder 12 which corresponds to the folding-blade system 20*b*. Conversely, the worm wheel 27 is connected to the shaft 26 having the central bore so as to be fixed against relative rotation with the shaft 26, which is pinned to that region of the folded-product guiding cylinder 12 which corresponds to the gripper system 20*a*. Because the electric motor 29, together with the worm 28, is connected to one moving system, and the worm wheel 27 to another moving system, it is possible for both systems to be moved relative to one another by the adjusting device 25.

By means of the drive 31, as aforementioned, driving torque is transmitted via the gearwheel 17.1 to the shaft 26 formed with a central bore and carrying the worm wheel 27 which is fixed thereto against relative rotation therewith. The worm 28, which meshes with the worm wheel 27, is driven by the electric motor 29, which is mounted on the end face of a cylinder segment of the folded-product guiding cylinder 12. Because the worm wheel 27, on the one hand, and the worm 28 together with electric motor 29, on the other hand, belong to different rotational systems, it is possible to effect an adjustment of the two rotational systems relative to one another, as aforementioned. The drive power is applied via the shaft 26 formed with the central bore to the gripper system 20*a*, which is pinned to the shaft 26, and is transmitted via the worm-gear drive 27, 28 to the folding-blade system 20*b* of the folded-product guiding cylinder 12. The worm drive 27, 28 represents the interface at which it is possible for a relative adjustment between the gripper system 20*a* and the folding-blade system 20*b*, for example, to be effected during the transmission of the power, without having to disengage any gearwheels.

It is further possible, through the intermediary of the hollow shaft 24 and the gearwheel 19.1, to effect a relative adjustment between folding members and transport members, respectively, on the folded-product guiding cylinder 9. The folding blades 10 can then be moved relative to the folding jaws 11 with the folded-product guiding cylinder 9. The adjustment is effected via the gear train by the adjusting device 25 provided in the folded-product guiding cylinder 12.

The transmission of power is consequently accomplished by means of a self-locking worm-gear drive in which the inter-meshing parts belong to different rotational systems and, therefore, permit an adjustment of the rotational systems relative to one another.

The fact that no fixed latching positions exist permits any desirable or necessary relative positions between the folding members and the transport members to be selected and set. An immediate response to individual production requirements, such as a delta fold-with-overlay production mode, for example, can be made without having to perform a tedious disengagement and re-engagement of gearwheels. The self-locking worm-gear drive 27, 28 which is provided ensures a precise maintenance of the originally selected set position.

Figure 4:
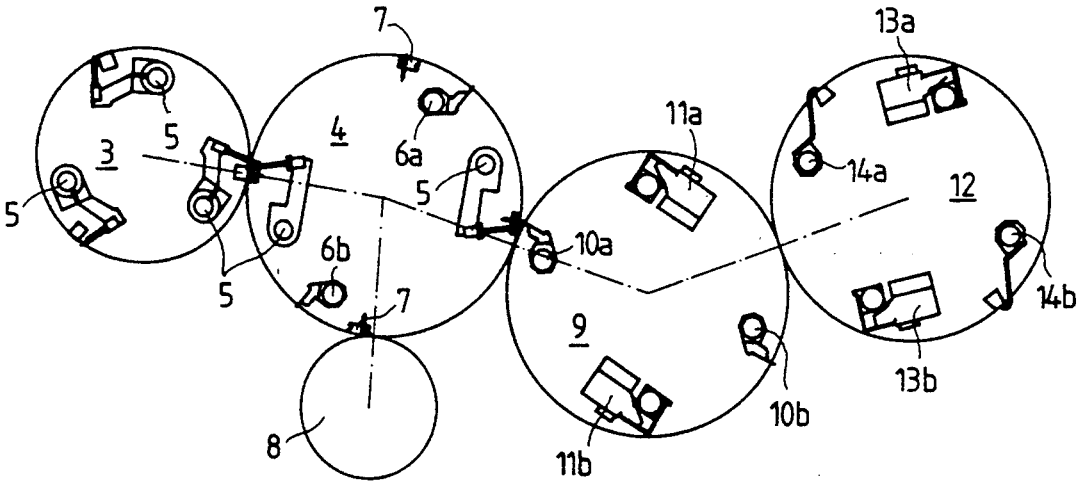
FIGS. 4 and 5 are slightly enlarged fragmentary views of FIG. 1 in different operating phases thereof, namely wherein the folding and transport members are in a first and second transverse-fold operating mode and in a delta-fold operating mode.
Figure 5:
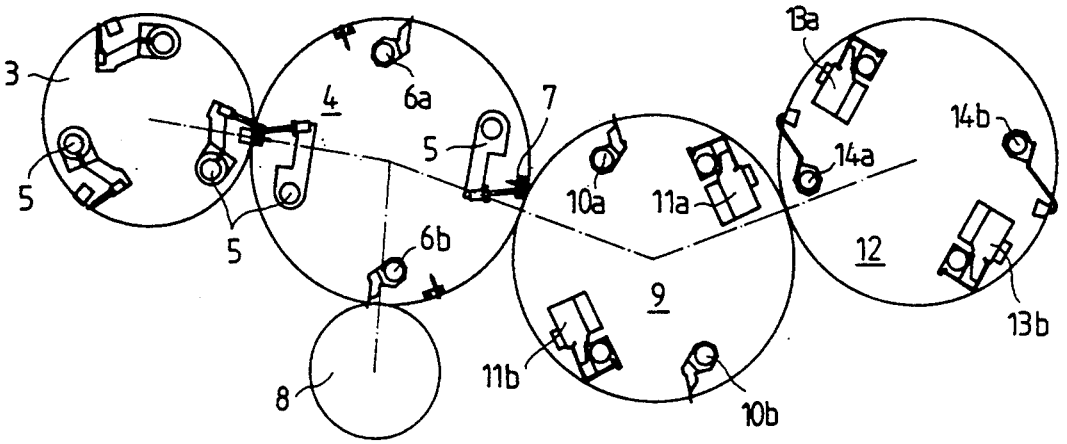

FIGS. 4 and 5 show operating positions of folding and transport members, respectively, in the first and second transverse-fold operating mode and also in the delta-fold operating mode.

In FIG. 4, the operating positions of folding and transport members on folded-product guiding cylinders 4, 9 and 12 are shown in the delta-fold mode. In this mode, the folding blade 6*a* of the folded-product guiding cylinder 4 is offset 120 degrees from the cutoff or separation point between the collecting cylinder 3 and the cutting blade 7. The folding blade 6*b* is similarly offset with respect to the folding blade 6*a*, which cooperates with the folding jaw 11*a* carried by the folded-product guiding cylinder 9. There is an angle of approximately 60 degrees between the folding blade 10*a* and the folding jaw 11*a*. The folding blade 10*a* cooperates with the folding jaw 13*a*, which is on the folded-product guiding cylinder 12. The folding jaw 13*a* and the gripper bridge 14 enclose an angle of 60 degrees therebetween.

If a changeover is to be made from this delta-fold operating mode to the first and second transverse-fold operating mode, the adjusting devices 25 in each of the folded-product guiding cylinders 4, 9 and 12 vary the operating positions of the folding and transport members relative to one another, as shown in FIG. 5. This may be effected on a job-specific basis by pressing a button at a control console of the printing machine.

In the first and second transverse-fold operating mode, the folding blade 6*a* of the folded-product guiding cylinder 4 is displaced so that it encloses a right angle, approximately, with the separation or cutoff point between the cutting blade 7 and the collecting cylinder 3. On the folded-product guiding cylinder 9, the folding blade 10*a* and the folding jaw 11*a* have moved closer together from the 60-degree to the 45-degree position. Furthermore, on the folded-product guiding cylinder 12, the gripper bridge 14*a* and the folding jaw 13*a* have been adjusted at an angle of 45 degrees to one another.

Figure 6:
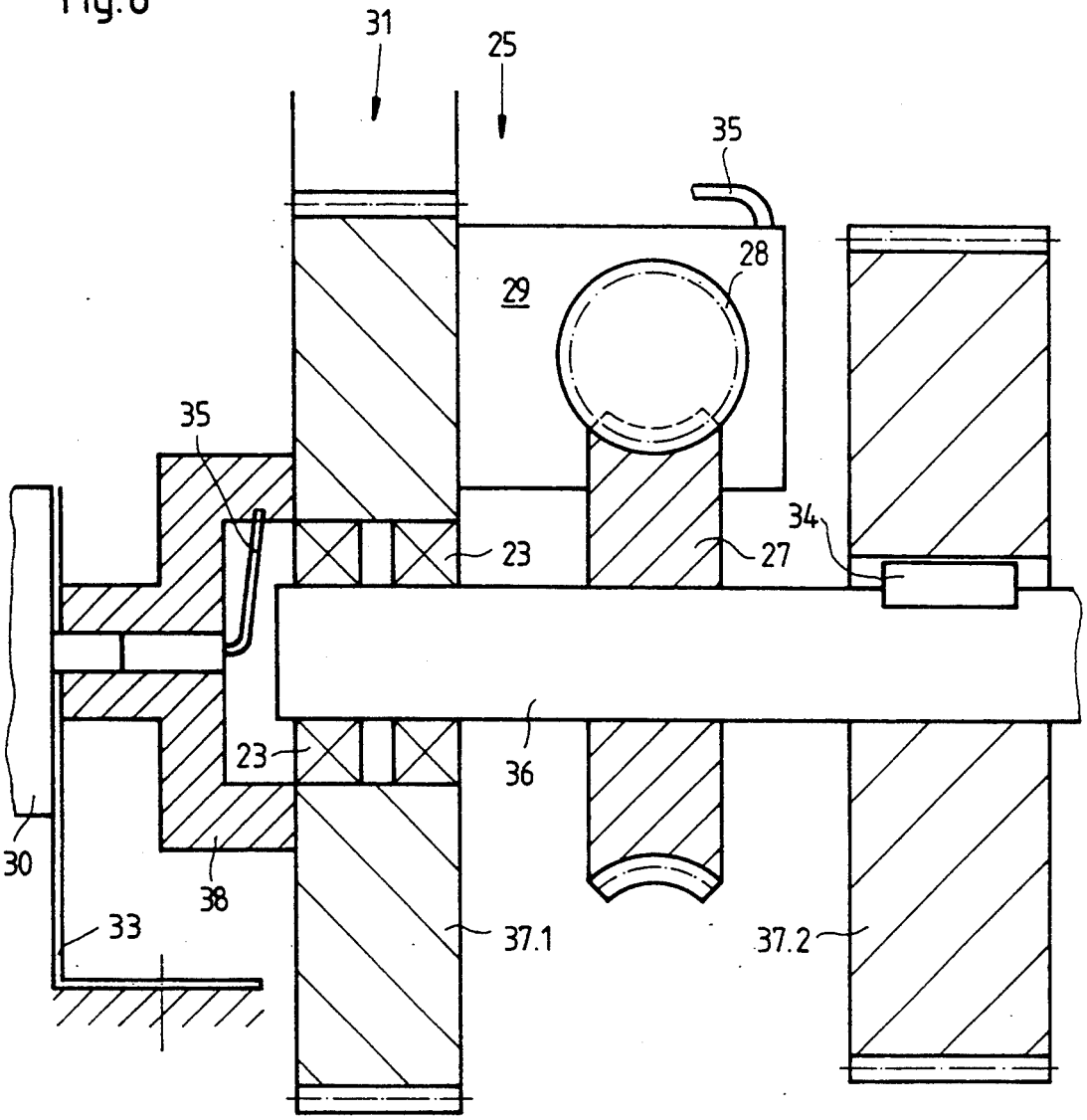
FIG. 6 is a somewhat enlarged view of FIG. 3 showing a different embodiment of the adjustment device for forming a second longitudinal fold between gearwheels.

FIG. 6 shows an adjusting device for the second longitudinal fold, disposed between two gearwheels. In this configuration, a gearwheel 37.1 is connected to a drive 31. The gearwheel 37.1 is provided with a rotary pass-through 38, which is connected to a power supply 30 resting on a bracket 33. The electric motor 29 flanged onto the gearwheel 37.1 is connected to the power supply 30 through the intermediary of an electrical connection 35 which extends through the rotary pass or lead-through 38. The electric motor 29 moves the worm 28, which meshes with a worm wheel 27 on a shaft 36. The shaft 36 is supported by two bearings 23 in the gearwheel 37.1, i.e., it is thus movable relative to the latter. When the electric motor 29 is energized during the rotation of the gearwheel 37, the shaft 36 is rotated through the intermediary of the worm-gear drive 27, 28; consequently, the position of the gearwheel 37.2 relative to the gearwheel 37.1 is varied while torque is being transmitted. The torque is transmitted via the feather key 34, which firmly interconnects the shaft 36 and the gearwheel 37.2 so that they are fixed against rotation relative to one another.

The potential for automation in the folding apparatus for adjustment operations is illustrated with reference to these selected operating positions. Just like the operating positions of folding and transport members on folded-product guiding cylinders, it is also possible for perforation positions to be varied. It is likewise possible to achieve super-fine corrections in the second longitudinal fold, because minimal adjustment travel paths are achieved. Because the adjustment and correction operations can be performed with the printing machine in operation, and also at very high production speeds, it is possible to achieve considerable economies in terms of paper waste or spoilage and in setting-up time periods.

Furthermore, the folding jaws 11*a*, 11*b*, 13*a* and 13*b* can be adjusted centrally as part of a presetting process or whenever there is a job change, by means of a control console 40 shown in FIG. 1. Thus, the distances between the fixed and movable parts of the respective folding jaw can be adapted to the different thicknesses of the spines of the folded copies in 8-page or 32-page production.

This improves both the quality of the products, as well as the operational reliability of the paper-processing machine.

The foregoing is a description corresponding in substance to German Application P 41 36 792.8, dated Nov. 8, 1991, the International priority of which is being claimed for the instant application, and which is hereby made part of this application. Any material discrepancies between the foregoing specification and the aforementioned corresponding German application are to be resolved in favor of the latter.

I claim:

1. In a folding apparatus of a rotary printing machine, the combination comprising at least one cylinder with adjustable folding blades and impaling pins mounted thereon, perforating rollers disposed upstream of said at least one cylinder as seen in a direction of travel of a web of printed product travelling through the folding apparatus, at least one further cylinder with folding jaws mounted thereon, and a folded-product guiding cylinder with gripper devices mounted thereon, said folding blades, said impaling pins, said folding jaws and said gripper devices being adjustably mounted in the respective cylinders adjacent and with respect to outer cylindrical surfaces thereof, a gear train for driving at least one of said cylinders, a device being integrated into said gear train and operatively connected to at least one of said cylinders for automatically adjusting the folding apparatus, and remotely controllable drive means for actuating said adjusting device for varying respective operating positions of said folding blades, said impaling pins, said folding jaws and said gripper elements relative to one another and relative to the respective outer cylindrical surfaces of the respective cylinders.

2. The combination according to claim 1, wherein said device for automatically adjusting a fold is disposed within one of said cylinders.

3. The combination according to claim 1, wherein a respective one of said cylinders has a drive shaft, and including a gear mounted on said drive shaft outside the respective one guiding cylinder so as to be rotatable relative to said drive shaft, said device for automatically adjusting the folding apparatus being affixed to said gear.

4. The combination according to claim 1, wherein a respective one of said cylinders has a drive shaft formed with a central bore, and including power-supply means connected via said drive shaft to said remotely controllable drive means for energizing said drive means.

5. The combination according to claim 1, wherein said remotely controllable drive means comprise an electric motor.

6. The combination according to claim 1, including a worm-gear drive mounted in a respective one of said cylinders, and means for connecting said remotely controllable drive means through the intermediary of said worm-gear drive to said folding blades, said impaling pins, said folding jaws, and said gripper elements.

7. The combination according to claim 1, including devices energized by a pressure-transmitting medium, and means for actuating the fold adjusting device via said energized devices for varying said operating positions of said folding blades, said impaling pins, said folding jaws, and said gripper elements relative to one another.

8. The combination according to claim 1, including means for regulating a second longitudinal fold through the intermediary of said adjusting device.

9. The combination according to claim 1, including means for centrally adjusting said folding jaws from a control console of the printing machine.

* * * * *